US006411175B1

(12) United States Patent
Sugawara et al.

(10) Patent No.: US 6,411,175 B1
(45) **Date of Patent: *Jun. 25, 2002**

(54) POWER DISTRIBUTION/SYNTHESIS APPARATUS

(75) Inventors: Satoru Sugawara, Miyagi; Koji Mizuno, Sendai, both of (JP)

(73) Assignee: Ricoh Company, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/452,693

(22) Filed: Dec. 3, 1999

(30) Foreign Application Priority Data

Dec. 9, 1998 (JP) ..... 10-366060

(51) Int. Cl.[7] ..... H01P 3/08; H01P 5/12
(52) U.S. Cl. ..... 333/127; 333/124
(58) Field of Search ..... 333/127, 128, 333/124, 125

(56) References Cited

U.S. PATENT DOCUMENTS 5,079,527 A * 1/1992 Goldfarb ..... 333/128
5,412,354 A * 5/1995 Quan ..... 333/121
5,543,571 A * 8/1996 Stedman et al. ..... 330/124 D
5,847,625 A * 12/1998 Gillette ..... 333/127
5,872,491 A * 2/1999 Kim et al. ..... 333/101

FOREIGN PATENT DOCUMENTS

JP 5-37212 2/1993

* cited by examiner

*Primary Examiner*—Robert Pascal
*Assistant Examiner*—Kimberly E Glenn
(74) *Attorney, Agent, or Firm*—Oblon, Spivak, McClelland, Maier & Neustadt, P.C.

(57) ABSTRACT

In a power divider/combiner, two quarter wavelength lines are connected to a first I/O terminal. A first transmission line is connected between the other end of one of the quarter wavelength lines and one of the second I/O terminals, a second transmission line is connected between the other end of the remaining quarter wavelength line and the remaining second I/O terminal, a third transmission line is connected between an absorption resistor and the one of the second I/O terminals, and a forth transmission line is connected between the absorption resistor and the remaining second I/O terminal. Assuming that the characteristic impedance at the I/O terminals is Z0, the characteristic impedance of each of the four transmission lines is set to $\sqrt{2}\cdot$Z0.

6 Claims, 8 Drawing Sheets

POWER DISTRIBUTION/SYNTHESIS APPARATUS

FIELD OF THE INVENTION

The present invention relates to a power divider/combiner applicable to communication equipment, measurement equipment, and some other equipment with a high-frequency circuit incorporated therein. More particularly, this invention relates to a power divider/combiner used mainly in a band from a quasi-millimeter wave to a millimeter wave and a submillimeter wave.

BACKGROUND OF THE INVENTION

As an example of a conventional type of power divider/combiner, there is the one shown in FIG. 6. In this figure, designated at the reference numerals 1, 2, and 3 are I/O terminals, at 4 a branch section, at r an absorption resistor, and at b a quarter wavelength line.

Two quarter wavelength lines b are connected to the I/O terminal 1 via the branch section 4, and the other ends of the quarter wavelength lines are connected to the I/O terminals 2 and 3 respectively. The I/O terminal 2 and the I/O terminal 3 are connected to each other through the absorption resistor r.

Operations of this apparatus are explained below. A signal supplied from the I/O terminal 1 is branched into the two quarter wavelength lines b with a uniform amplitude, and the branched signals are fetched from the I/O terminal 2 and the I/O terminal 3. Each of the quarter wavelength lines b operates as an impedance converter and matches a characteristic impedance Z0 of the I/O terminal 1 to that of each external circuit connected to the I/O terminal 2 and I/O terminal 3. The absorption resistor r absorbs unbalanced components of the I/O terminals 2 and 3 to provide isolation between the I/O terminal 2 and the I/O terminal 3.

FIG. 7A and FIG. 7B show a S parameter when a design frequency in the power divider/combiner shown in FIG. 6 is set to 25 GHz. FIG. 7A is shown in dB, and FIG. 7B shows a Smith chart. As shown in this figure, the amount of reflection S11 and S22 from each of the I/O terminals and the isolation S23 between the I/O terminal 2 and the I/O terminal 3 are zero at the design frequency of 25 GHz, which shows that a complete matching and isolation is achieved therebetween. In this figure, lines S11 and S23 are seen as one line, but in fact are there are two separate lines that are superimposed on each other each representing S11 and S23. The above explanation is for a case where power is distributed using this power divider/combiner. However, when power is to be synthesized, a flow of signal is only in the opposite direction because a plurality of inputs are synthesized into one output. Accordingly, only the I/O terminals are replaced with each other and the other components in the circuit configuration are the same as those in FIG. 6, in which the relation between impedances or the like holds as it is. Therefore, only a case of power distribution is described below, and description of a case of power synthesis will be omitted.

Conventionally, the frequency used in a power divider/combiner was not so high. Therefore, the main technical object was how to minimize the size of the overall circuit. In recent years, however, the operational frequency of high frequency circuitry has been shifted from a microwave band to a millimeter wave band or a submillimeter wave band due to exhaustion of frequency resources as well as due to enhancement in performance of active elements in a semiconductor. In association with this tendency, the length of the quarter wavelength line became as short as around 1 mm or less. Therefore, presently the problem of size of the power divider/combiner itself is not as big as it used to be earlier.

Further, an absorption resistor has been considered as a lumped constant element in principle, so that a physical size of the resistor was not considered important. However, to assume that the absorption resistor is a lumped constant element, the size of the absorption resistor has to be made smaller according to miniaturization of the power divider/combiner. However, when the size of the absorption resistor is made smaller, the space between lines of the I/O terminals linked to each other via the absorption resistor becomes narrow, which causes design options to be restricted and increases the crosstalk.

On the other hand, in order to suppress crosstalk, for example, the power divider/combiner in FIG. 8 can be used. FIG. 8 shows a configuration of the power divider/combiner which suppresses crosstalk by providing lines c each between the absorption resistor r and each of quarter wavelength lines b. In this figure, the reference numerals 1 to 3 indicate I/O terminals, and the reference numeral 4 indicates a branch section.

FIG. 9 shows S Parameters when the line c whose electrical length is 20 degrees assuming that the design frequency in the power divider/combiner in FIG. 8 is 25 GHz. FIG. 9A is shown in dB and FIG. 9B shows a Smith chart. In this figure, lines S11 and S23 are seen as one line, but in fact there are two separate lines that are superimposed on each other each representing S11 and S23.

As shown in this figure, the isolation S23 between the I/O terminal 2 and the I/O terminal 3 is as high as −18.2 dB at the design frequency of 25 GHz. As described above, the power divider/combiner in FIG. 8 can suppress crosstalk, but the isolation between the I/O terminal 2 and the I/O terminal 3 worsens significantly.

As a basic transmission line especially for a high-frequency circuit such as an MMIC, an easily-designable micro-strip line has mainly been used. However, in recent years, the mainstream has shifted to a CPW which can be easily connected to a semiconductor device. Although the CPW has the characteristic of easy connectability to the semiconductor device because a signal line and a grounded conductor are located on one plane, its layout is complicated. Namely, an air bridge is required for a discontinuous section, and flexibility in the layout is significantly reduced as compared to that of the micro-strip line when a space between the lines described above is made extremely narrow.

As described above, in the Wilkinson type of power divider/combiner based on the conventional technology, a size of an absorption resistor has to be made smaller so that it is more negligible as compared to a wavelength of a design frequency. Therefore, there is a problem that flexibility in the layout or isolation between I/O terminals connected to each other via the absorption resistor is reduced. The problem described above becomes more obvious especially in the CPW which is popular in recent years.

SUMMARY OF THE INVENTION

It is an object of the present invention to provide a Wilkinson type of power divider/combiner with a high degree of flexibility in its layout and a high degree of isolation between I/O terminals connected to each other via an absorption resistor.

In the present invention, a transmission line with a length L having the characteristic impedance of $\sqrt{2}\cdot$Z0 is provided between an absorption resistor and each of second I/O terminals and further between each of quarter wavelength lines and the second I/O terminal corresponding to the quarter wavelength line. Therefore, it is possible to provide a sufficient space between the I/O terminals with isolation therebetween via the absorption resistor kept at high level. As a result, a power divider/combiner in which crosstalk does not occur and the degree of flexibility in its layout is high can be obtained.

Further, the length L of the transmission line is set to a half wavelength or an integral multiple of the half wavelength. Accordingly, a characteristic impedance of this newly added transmission line is equivalent to that of a quarter wavelength line. Therefore, matching among all of the components is completely achieved so that the possibility of occurrence of unnecessary reflection is eliminated. Although complete matching is performed based on a design wavelength, there is the tendency that the frequency band width becomes narrower as the length of the connected transmission line increases. To overcome this problem, it is preferable that the transmission line to be connected is a half wavelength. As a result, a power divider/combiner in which matching of the all the components can be achieved, crosstalk does not occur and the degree of flexibility in its layout is high can be obtained.

Further, the circuit is formed with a CPW. Therefore, the space required for provision of an air bridge or the like, in other words, a space between I/O terminals connected to each other via an absorption resistor can be insured. As a result, a power divider/combiner in which crosstalk does not occur, the degree of flexibility in its layout is high and that can easily be connected to a semiconductor device can be obtained.

Other objects and features of this invention will become apparent from the following description with reference to the accompanying drawings.

DESCRIPTION OF THE PREFERRED EMBODIMENTS

Preferred embodiments of the power divider/combiner according to the present invention are described in detail below in the order of outline of the present invention, and first to third embodiments with reference to the attached drawings.

Outline of the Present Invention

In the power divider/combiner according to the present invention, a transmission line of length L and having the characteristic impedance of $\sqrt{2}\cdot Z0$ is provided between an absorption resistor and each of second of I/O terminals and further between each quarter wavelength line and the second I/O terminal corresponding to the quarter wavelength line. Therefore, sufficient space can be insured between I/O terminals and isolation between the I/O terminals linked to each other via an absorption resistor can be kept at a high level.

In the Wilkinson type of power divider/combiner, each of the quarter wavelength lines matches the impedance between the I/O terminals, and at the same time plays a role of controlling a phase difference between the lines. More specifically, when a phase difference between the following two paths:

1. I/O terminal→Absorption resistor→I/O terminal,
2. I/O terminal→Quarter wavelength line→Branch section→Quarter wavelength line→I/O terminal is a half wavelength, high-frequency signals passing through the paths respectively can cancel each other out, which makes isolation between the I/O terminals high. Accordingly, even if a line is added between an absorption resistor and an output terminal, a phase difference of a half wavelength between the half wavelength lines can be insured by adding a transmission line with the same length as that of the line between the I/O terminal and the quarter wavelength line.

The characteristic impedance of the added line herein is set line equivalent to that of the quarter wavelength line. Therefore, unnecessary reflection can be suppressed.

Figure 1:
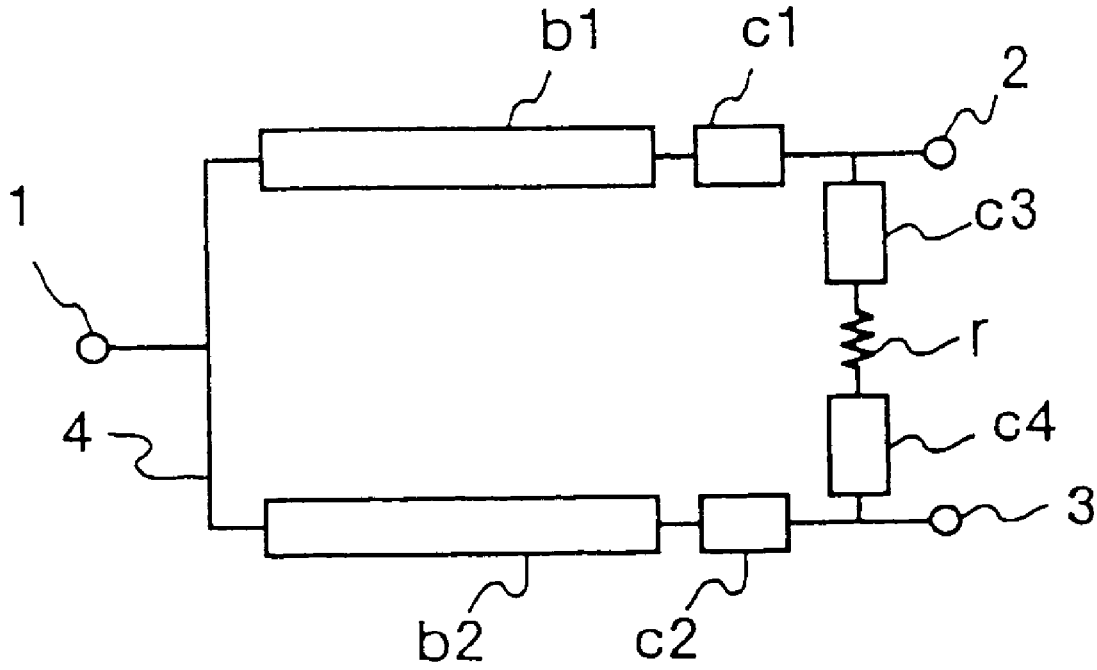
FIG. 1 is a circuit diagram of a power divider/combiner according to a first embodiment of the present invention.

FIG. 1 is a circuit diagram of a power divider/combiner according to a first embodiment of the present invention. In this figure, designated at the reference numerals 1, 2, and 3 are I/O terminals, at 4 a branch section, at r an absorption resistor, at b1 and b2 quarter wavelength lines. Transmission lines c1 to c4, each having a electrical length of 20 degrees, are added based on the present invention.

Two-quarter wavelength lines b1 and b2 are connected to the I/O terminal 1 via the branch section 4. The transmission line c1 is connected to the other end of the quarter wavelength line b1, and the other end of this transmission line c1 is connected to the I/O terminal 2. The transmission line c2 is connected to the other end of the quarter wavelength line b2, and the other end of this transmission line c2 is connected to the I/O terminal 3.

The transmission line c3 is connected to one end of the absorption resistor r, and the transmission line c4 is connected to the other end thereof.

The other end of the transmission line c3 is connected to the I/O terminal 2, and the other end of the transmission line c4 is connected to the I/O terminal 3. As described above, the I/O terminals 2 and 3 are connected to each other via the transmission line c3, absorption resistor r, and transmission line c4. The characteristic impedance of each of the quarter wavelength lines b1, b2 and transmission lines c1 to c4 is $\sqrt{2}\cdot Z0$.

The operation in the above-described configuration is explained below. A signal applied from the I/O terminal 1 is distributed into the quarter wavelength line b1 and the transmission line c1 as well as into the quarter wavelength line b2 and the transmission line c2 in a uniform amplitude via the branch section 4, and the distributed signals are fetched from the I/O terminals 2 and 3. Each of the quarter wavelength lines b1 and b2 operates as an impedance converter and matches a characteristic impedance Z0 the I/O terminal 1 to that of each external circuit connected to the I/O terminal 2 and I/O terminal 3. The absorption resistor r absorbs unbalanced components of the I/O terminals 2 and 3 and thus provides an isolation between the I/O terminal 2 and the I/O terminal 3.

As described above, by providing the transmission line c3 between the absorption resistor r and the I/O terminal 2 and the transmission line c4 between the absorption resistor r and the I/O terminal 3, crosstalk can be suppressed. In addition, by providing the transmission line c1 between the quarter wavelength line b1 and the I/O terminal 2 and the transmission line c2 between the quarter wavelength line b2 and the I/O terminal 3, high-frequency signals passing through the paths described below respectively cancel each other out, which also allows isolation between the I/O terminals 2 and 3 to highly be insured.

1. I/O terminal 1→Absorption resistor r→Transmission line c3→Transmission line→c4→I/O terminal 3,
2. I/O terminal 2→Transmission line c1→Quarter wavelength line b1→Branch section 4→Quarter wavelength line b2→Transmission line c2→I/O terminal 3.

Dimensions in this embodiment designed with a microstrip line formed on a polyimide film with a characteristic impedance of each I/O terminal of 50 Ω, a frequency of 25 GHz, a thickness of 100 μm, and dielectric constant of 3.5 are as follows: each of quarter wavelength lines b1 and b2 has a characteristic impedance of 70.71 Ω, width 0.124 mm, and length 1.835 mm; and each of the transmission lines c1 to c4 has a characteristic impedance of 70.71 Ω, width 0.124 mm, and length 0.408 mm.

Figure 2A:
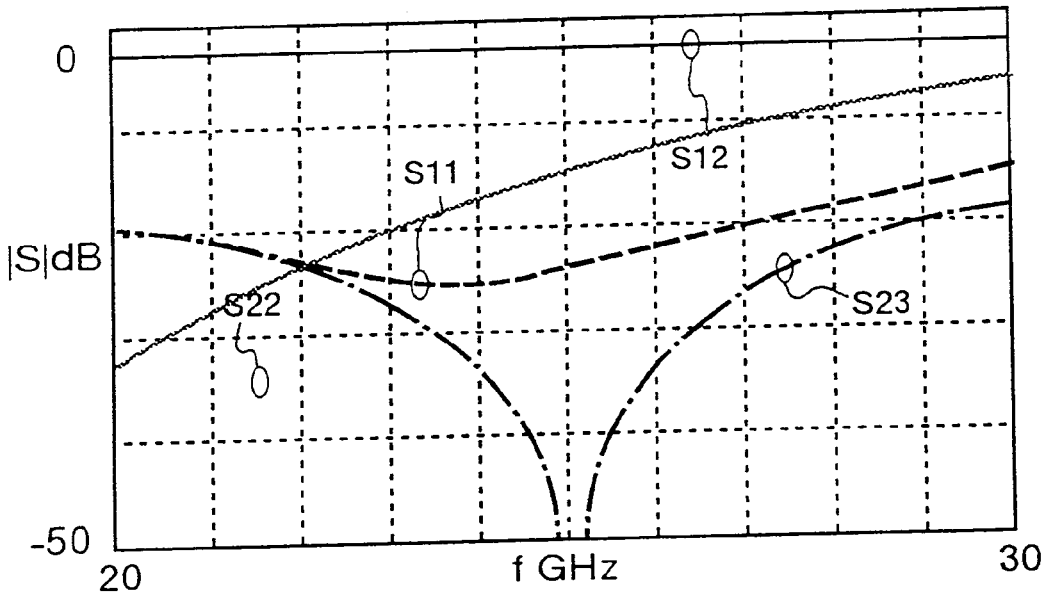
FIG. 2A and FIG. 2B are views showing S parameters of the power divider/combiner shown in FIG. 1.
Figure 2B:
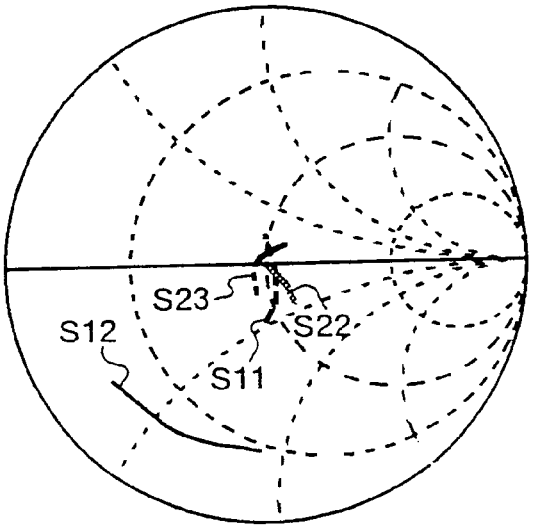

The S parameters in this case are shown in FIG. 2A and FIG. 2B. FIG. 2A is shown in dB, and FIG. 2B shows a Smith chart. The isolation between the I/O terminals 2 and 3 indicated by a line S23 is zero at the design frequency of 25 GHz, which shows that complete isolation is achieved therebetween.

As described above, in the power divider/combiner according to the first embodiment described above, by providing the transmission line c1 of length L and characteristic impedance $\sqrt{2}\cdot Z0$ between quarter wavelength line bland the I/O terminal 2, the transmission line c2 of length L and characteristic impedance $\sqrt{2}\cdot Z0$ between the quarter wavelength line b2 and the I/O terminal 3, the transmission line c3 of length L and characteristic impedance $\sqrt{2}\cdot Z0$ between the absorption resistor r and the I/O terminal 2, and further by providing the transmission line c4 of length L and characteristic impedance $\sqrt{2}\cdot Z0$ between the absorption resistor r and the I/O terminal 3, crosstalk can be suppressed, space between I/O terminals can sufficiently be insured and isolation between the I/O terminals can be kept at a high level.

Figure 3:
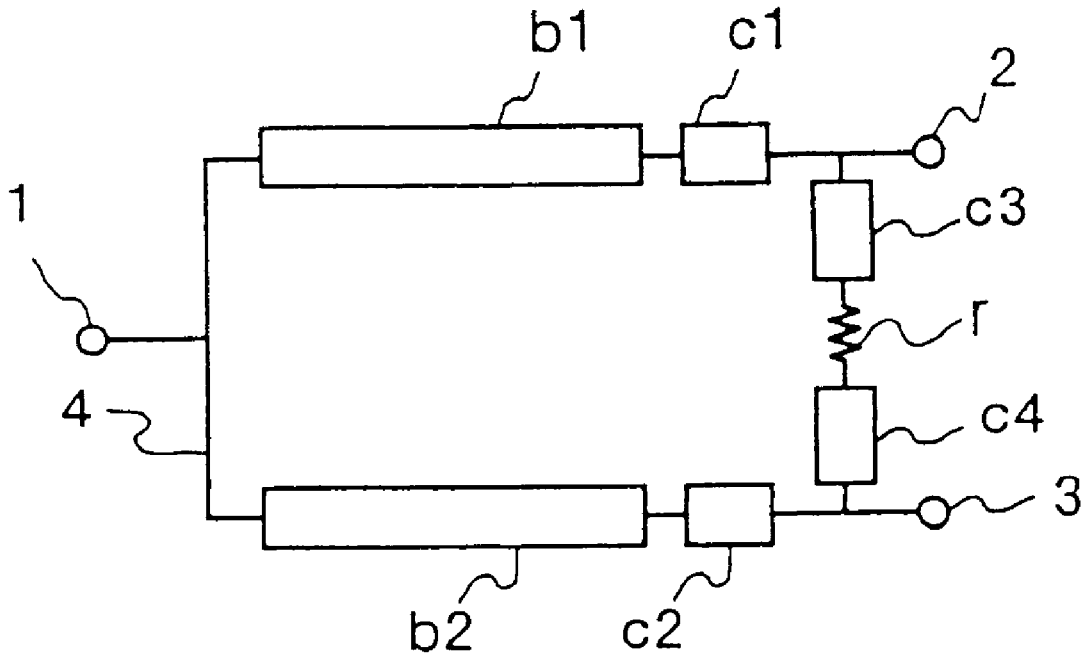
FIG. 3 is a circuit diagram of a power divider/combiner according to a second embodiment of the present invention.

FIG. 3 is a circuit diagram of a power divider/combiner according to a second embodiment of the present invention. In this figure, designated at the reference numerals 1, 2, and 3 are I/O terminals, at 4 a branch section, at a an absorption resistor, at b1 and b2 quarter wavelength lines. Transmission lines c1 to c4, each having a electrical length of 180 degrees, are added according to the present invention. The configuration is the same as that of the power divider/combiner according to the first embodiment except the electrical length of the transmission lines c1 to c4 is different therefrom, so that description thereof is omitted here.

Dimensions in the embodiment designed with a microstrip line formed on a polyimide film with a characteristic impedance of each I/O terminal of 50 Ω, a frequency of 25 GHz, a thickness of 100 μm, and dielectric constant of 3.5 are as follows: each of quarter wavelength lines b1 and b2 has a characteristic impedance of 70.71 Ω, width 0.124 mm, and length 5.505 mm; and each of the transmission lines c1 to c4 has a characteristic impedance of 70.71 Ω, width 0.124 mm, and length 3.67 mm.

Figure 4A:
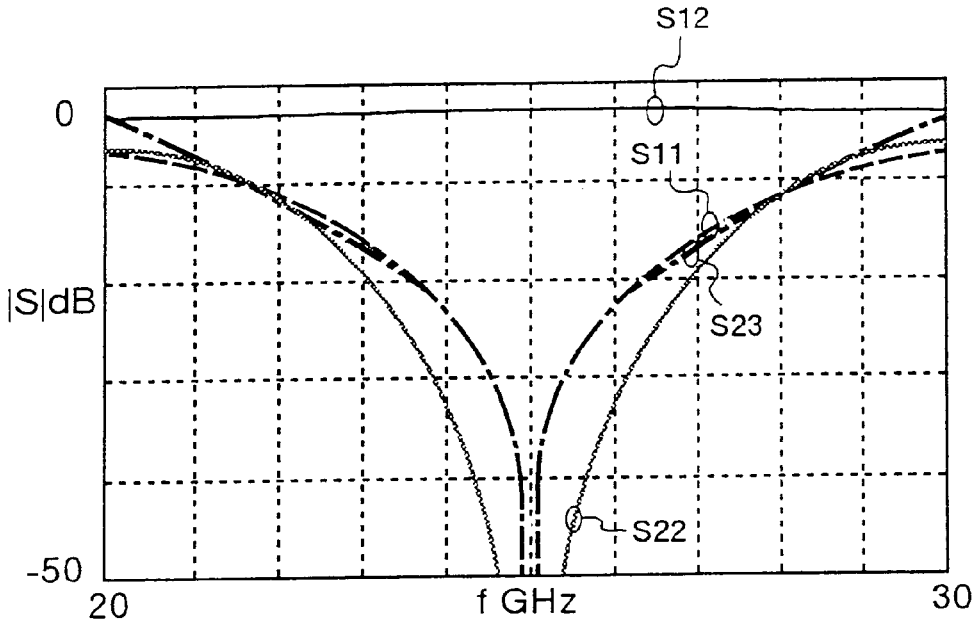
FIG. 4A and FIG. 4B are views showing S parameters of the power divider/combiner shown in FIG. 3.
Figure 4B:
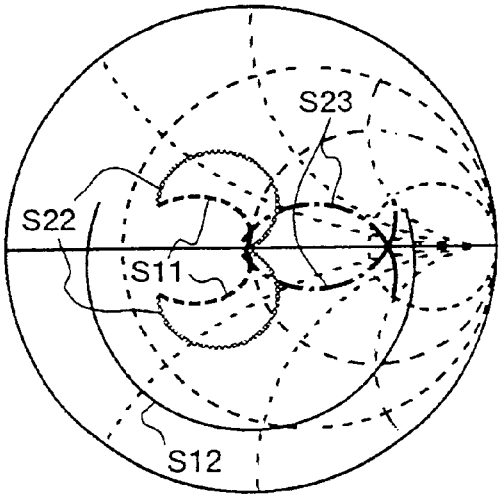

The S parameters in this case are shown in FIG. 4A and FIG. 4B. FIG. 4A is shown in dB, and FIG. 4B shows a Smith chart. The amount of a reflection of each I/O terminal indicated by lines S11 and S12 and isolation between the I/O terminals 2 and 3 indicated by line S23 are zero at the design frequency of 25 GHz, which shows that a complete matching and isolation are achieved therebetween.

As described above, in the power divider/combiner according to the second embodiment described above, by providing the transmission line c1 of half wavelength between the quarter wavelength line b1 and the I/O terminal 2, the transmission line c2 of half wavelength between the quarter wavelength line b2 and the I/O terminal 3, the transmission line c3 of half wavelength between the absorption resistor r and the I/O terminal 2, and further by providing the transmission line c4 of half wavelength between the absorption resistor r and the I/O terminal 3, matching among all of the components can completely be performed. In addition, crosstalk can be suppressed, space between I/O terminals can sufficiently be insured and isolation between the I/O terminals kept at a high level.

Figure 5:
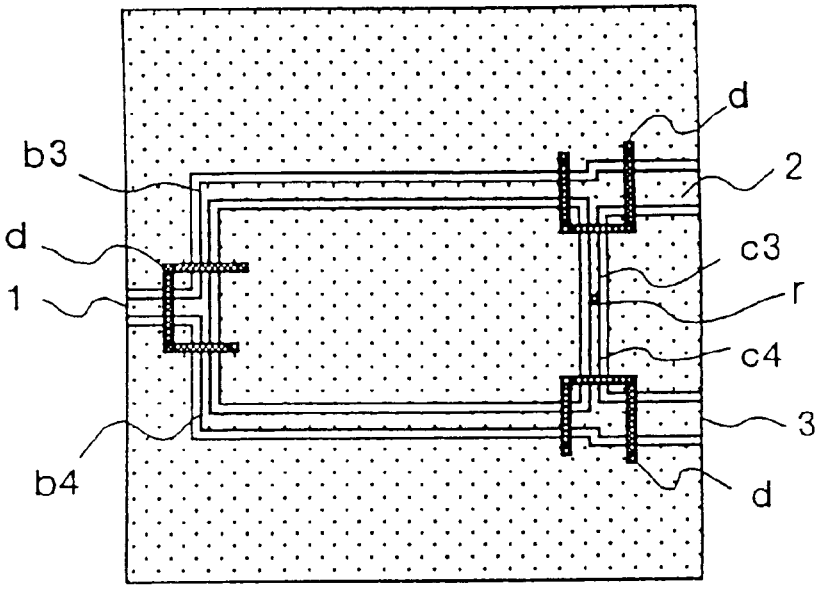
FIG. 5 is a circuit diagram of a power divider/combiner according to a third embodiment of the present invention.
Figure 6:
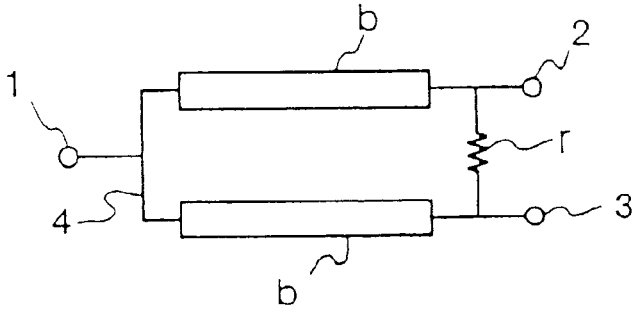
FIG.6 (CONVENTIONAL ART)
FIG. 6 is a circuit diagram of one example of a power divider/combiner based on the conventional technology.
Figure 7A:
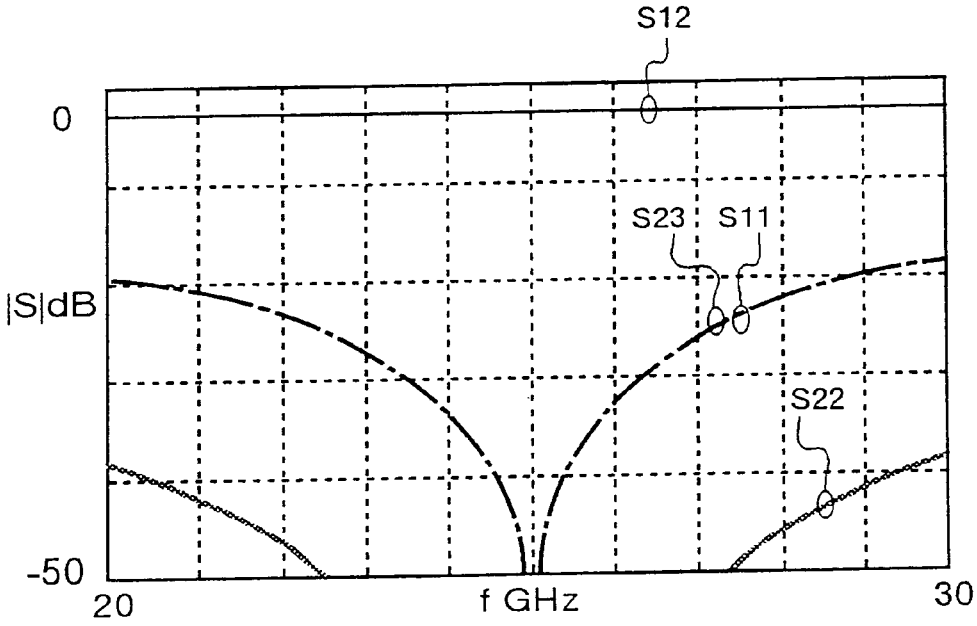
FIG. 7A and FIG. 7B are views showing S parameters of the power divider/combiner shown in FIG. 6.
Figure 7B:
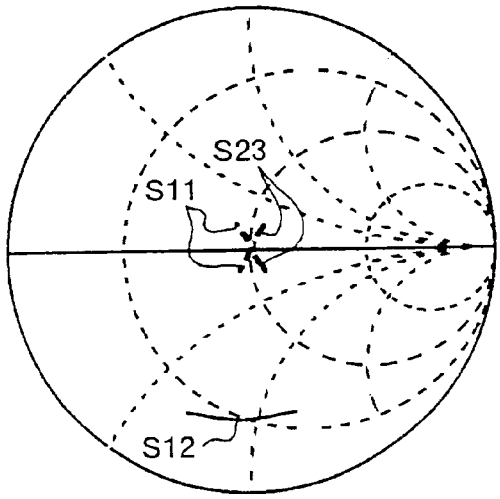
Figure 8:
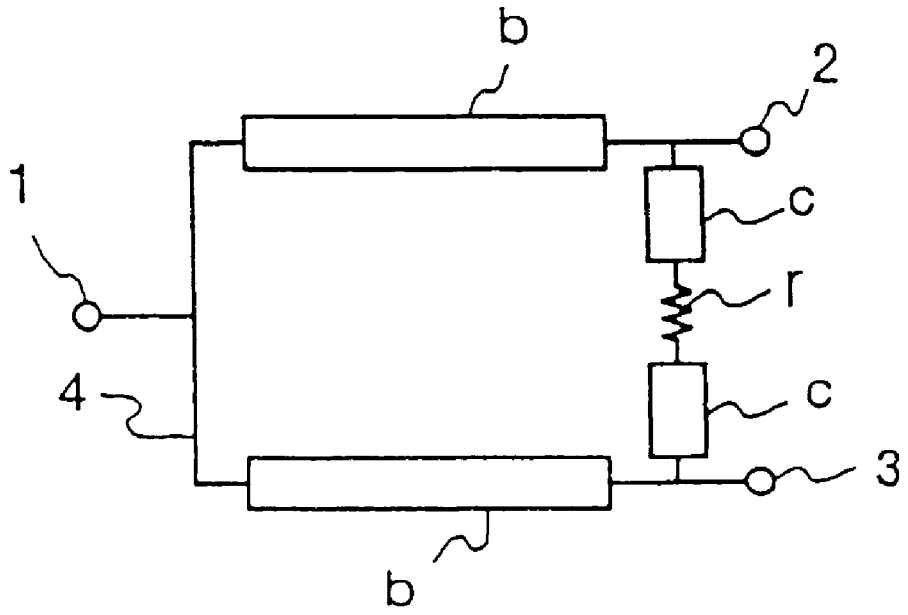
FIG.8 (CONVENTIONAL ART)
FIG. 8 is a circuit diagram of another example of the power divider/combiner based on the conventional technology.
Figure 9A:
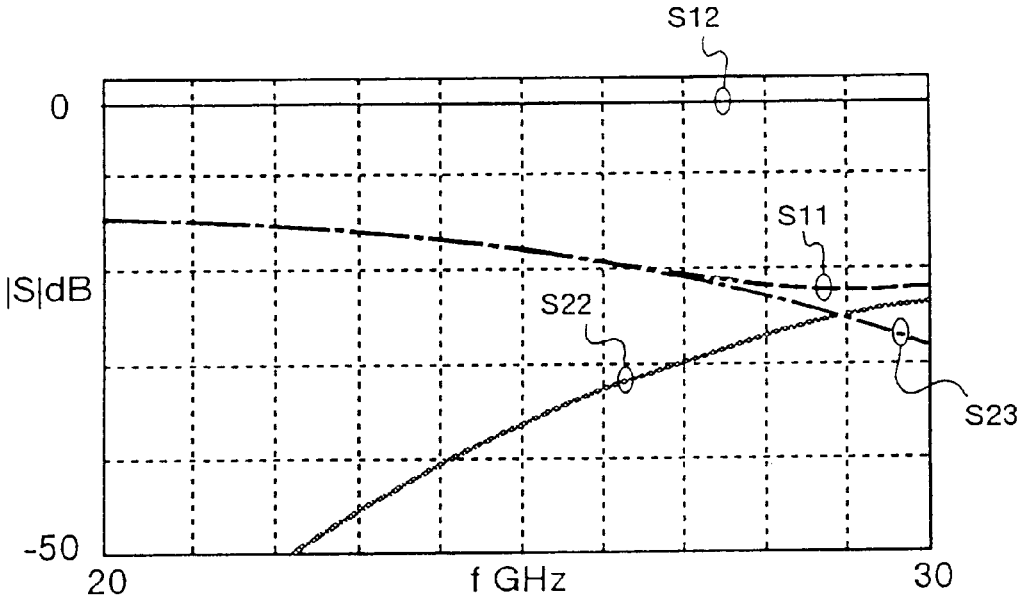
FIG.9A (CONVENTIONAL ART)
FIG. 9A and FIG. 9B are views showing S parameters of the power divider/combiner shown in FIG. 8.
Figure 9B:
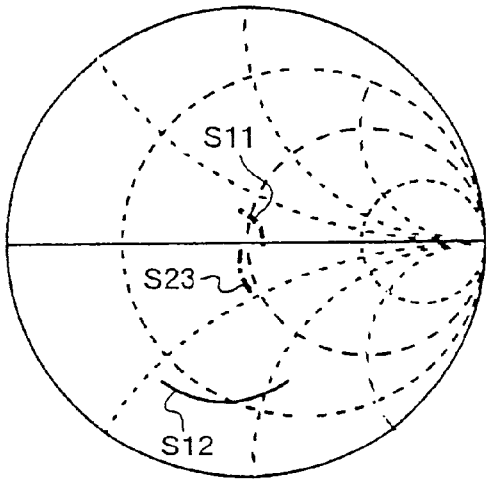
FIG.9B (CONVENTIONAL ART)

FIG. 5 is a circuit diagram of a power divider/combiner according to a third embodiment of the present invention. In this figure, designated at the reference numerals 1, 2, and 3 are I/O terminals, at r an absorption resistor, at b3 and b4 quarter wavelength lines. Transmission lines c3 and c4, each having electrical length of 20 degrees (a total electrical length is 110 degrees), are added according to the present invention, as is at d an air bridge.

Dimensions in the embodiment designed with a CPW formed on a polyimide film with a characteristic impedance of each I/O terminal of 50 Ω, a frequency of 25 GHz, a thickness of 100 μm, and dielectric constant of 3.5 are as follows: each of lines b3 and b4 has a characteristic impedance of 70.71 Ω, width of the central conductor 0.029 mm, gap width 0.01 mm, and length 2.436 mm; and each of the transmission lines c3 and c4 has a characteristic impedance of 70.71 Ω, width of the central conductor 0.029 mm, gap width 0.01 mm, and length 0.443 mm.

As described above, the power divider/combiner according to the third embodiment is a complicated circuit including air bridges. However, a layout with a sufficient space between the output terminals 2 and 3 can be insured by providing the transmission lines c3 and c4 therein.

The present invention is not limited to the embodiments described above, and can be constructed by embodying all modifications and alternative constructions that may occur to one skilled in the art which fairly fall within the basic teaching herein set forth. For example, the present invention is applicable to a power divider/combiner apparatus using N units of I/O terminals for one I/O terminal. In this case, a characteristic impedance of the quarter wavelength lines and the transmission lines of length L will be $\sqrt{2}\cdot Z0$.

In addition, even if the absorption resistor can not be made sufficiently smaller because of the necessity for use with large electric power, a completely-matched power divider/combiner can easily be produced by designing a transmission line through addition of a change rate in a phase in the absorption resistor to a quarter wavelength line.

As described above, the present invention provides a transmission line of length L and characteristic impedance $\sqrt{2}\cdot Z0$ between the absorption resistor and each of the second I/O terminals and further between each of quarter wavelength lines and the second I/O terminal corresponding to the quarter wavelength line. Therefore, it is possible to suppress crosstalk, provide a sufficient space between the I/O terminals and thus keep the isolation therebetween at a high level.

Further, transmission lines of length L set to a half wavelength or an integral multiple of the half wavelength are provided between the absorption resistor and each of the second I/O terminals and further between each of the quarter wavelength lines and the second I/O terminal corresponding to the quarter wavelength line. Therefore, it is possible to completely perform all the matching, suppress crosstalk, provide a sufficient space between the I/O terminals and thus keep the isolation therebetween at a high level.

Further, the circuit is formed with a CPW. Therefore, it is possible to obtain a power divider/combiner in which there is a high degree of flexibility in its layout and can easily be connected to a semiconductor device.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A Wilkinson type of power divider/combiner apparatus, in which the characteristic impedance of first and second I/O terminals is Z0, said apparatus comprising:

one said first I/O terminal;

two said second I/O terminals;

two quarter wavelength lines having a characteristic impedance of $\sqrt{2}\cdot$Z0, one terminal of each of which is connected to the first I/O terminal;

an absorption resistor connected between another terminal of each of said quarter wavelength lines;

a first transmission line of a length L adjacent to said absorption resistor such that the characteristic impedance will be $\sqrt{2}\cdot$Z0 provided between said absorption resistor and one of said second I/O terminals;

a second transmission line of a length L adjacent to said absorption resistor such that the characteristic impedance will be $\sqrt{2}\cdot$Z0 provided between said absorption resistor and another of said second I/O terminals;

a third transmission line of a length L such that the characteristic impedance will be $\sqrt{2}\cdot$Z0 provided between one of said quarter wavelength lines and the one of said second I/O terminals; and a fourth transmission line of a length L such that the characteristic impedance will be $\sqrt{2}\cdot$Z0 provided between other of said quarter wavelength lines and the another of said second I/O terminals.

2. The power divider/combiner according to claim 1, wherein:

said first transmission line is provided between said absorption resistor and a first junction connecting said third transmission line and said one of said second I/O terminals, and said second transmission line is provided between said absorption resistor and a second junction connecting said fourth transmission line and said other of said second I/O terminals.

3. The power divider/combiner according to claim 2, wherein:

said third transmission line is provided between said first junction and said one of said quarter wavelength lines, and said fourth transmission line is provided between said second junction and said other of said quarter wavelength lines.

4. A Wilkinson type of power divider/combiner apparatus, in which the characteristic impedance of first and second I/O terminals is Z0, said apparatus comprising:

one said first I/O terminal;

two said second I/O terminals;

two quarter wavelength lines having a characteristic impedance of $\sqrt{2}\cdot$Z0, one terminal of each of which is connected to the first I/O terminal;

an absorption resistor connected between another terminal of each of said quarter wavelength lines;

a transmission line of a length L such that the characteristic impedance will be $\sqrt{2}\cdot$Z0 provided between said absorption resistor and one of said second I/O terminals;

a transmission line of a length L such that the characteristic impedance will be $\sqrt{2}\cdot$Z0 provided between said absorption resistor and another of said second I/O terminals;

a transmission line of a length L such that the characteristic impedance will be $\sqrt{2}\cdot$Z0 provided between one of said quarter wavelength lines and the one of said second I/O terminals; and a transmission line of a length L such that the characteristic impedance will be $\sqrt{2}\cdot$Z0 provided between other of said quarter wavelength lines and the another of said second I/O terminals, and wherein the length L of said transmission lines is equal to half wavelength or an integral multiple of half wavelength.

5. The power divider/combiner according to claim 4; wherein each of said transmission lines provided in this circuit are formed with CPW (Co-Planar Waveguide).

6. A Wilkinson type of power divider/combiner apparatus, in which the characteristic impedance of first and second I/O terminals is Z0, said apparatus comprising:

one said first I/O terminal;

two said second I/O terminals;

two quarter wavelength lines having a characteristic impedance of $\sqrt{2}\cdot$Z0, one terminal of each of which is connected to the first I/O terminal;

an absorption resistor connected between another terminal of each of said quarter wavelength lines;

a transmission line of a length L such that the characteristic impedance will be $\sqrt{2}\cdot$Z0 provided between said absorption resistor and one of said second I/O terminals;

a transmission line of a length L such that the characteristic impedance will be $\sqrt{2}\cdot$Z0 provided between said absorption resistor and another of said second I/O terminals;

a transmission line of a length L such that the characteristic impedance will be $\sqrt{2}\cdot$Z0 provided between one of said quarter wavelength lines and the one of said second I/O terminals; and a transmission line of a length L such that the characteristic impedance will be $\sqrt{2}\cdot$Z0 provided between other of said quarter wavelength lines and the another of said second I/O terminals, and wherein each of said transmission lines provided in this circuit are formed with CPW (Co-Planar Waveguide).

* * * * *

UNITED STATES PATENT AND TRADEMARK OFFICE

CERTIFICATE OF CORRECTION

PATENT NO. : 6,411,175 B1
DATED : June 25, 2002
INVENTOR(S) : Sugawara et al.

It is certified that error appears in the above-identified patent and that said Letters Patent is hereby corrected as shown below:

Title page, Item [54] and Column 1, line 1,
Should read:

-- POWER DIVIDER/COMBINER --

Signed and Sealed this

Seventh Day of January, 2003

JAMES E. ROGAN
*Director of the United States Patent and Trademark Office*